US010646019B2

(12) United States Patent
Salciarini et al.

(10) Patent No.: US 10,646,019 B2
(45) Date of Patent: May 12, 2020

(54) COSMETIC POT COMPRISING A SYSTEM FOR PRESSURIZING A PRODUCT SUPPLY CONTAINER

(71) Applicant: CHANEL PARFUMS BEAUTE, Neuilly-sur-Seine (FR)

(72) Inventors: Christian Salciarini, Hyeres (FR); Julien Chandelier, Massy (FR); Gregory Perbal, Verrieres le Buisson (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 16/064,946

(22) PCT Filed: Dec. 19, 2016

(86) PCT No.: PCT/FR2016/053552

§ 371 (c)(1),
(2) Date: Jun. 21, 2018

(87) PCT Pub. No.: WO2017/109366

PCT Pub. Date: Jun. 29, 2017

(65) Prior Publication Data

US 2019/0000217 A1 Jan. 3, 2019

(30) Foreign Application Priority Data

Dec. 22, 2015 (FR) ..... 15 63149

(51) Int. Cl.
*A45D 40/22* (2006.01)
*A45D 40/00* (2006.01)

(52) U.S. Cl.
CPC ..... *A45D 40/22* (2013.01); *A45D 40/0075* (2013.01); *A45D 2200/051* (2013.01); *A45D 2200/055* (2013.01); *A45D 2200/056* (2013.01)

(58) Field of Classification Search
CPC ..... A45D 40/22; A45D 40/0075; A45D 2200/051; A45D 2200/055; A45D 2200/056
See application file for complete search history.

(56) References Cited

U.S. PATENT DOCUMENTS

| | | | |
|---|---|---|---|
| 2,471,852 | A | 5/1949 | Gordon |
| 3,335,913 | A | 8/1967 | Bouet |

(Continued)

FOREIGN PATENT DOCUMENTS

| | | |
|---|---|---|
| DE | 1482675 | 7/1969 |
| FR | 2869771 | 11/2005 |
| WO | 2014208945 | 12/2014 |

OTHER PUBLICATIONS

English language translation of Written Opinion of the International Searching Authority, dated Mar. 29, 2017 of PCT/FR2016/053552.

*Primary Examiner* — Frederick C Nicolas
(74) *Attorney, Agent, or Firm* — Greenblum & Berstein, P.L.C.

(57) ABSTRACT

A cosmetic pot having a base including a body, a press bottom attached to the body, a container of variable volume attached to the press bottom and positioned between the body and the press bottom, a system for pressurizing the container configured to compress the container against the press bottom, and a product dispenser arranged on the opposite side of the press bottom to the container, the product dispenser including a stopper, a dispensing head; configured to dispense product to a user and to open or close the stopper, and a resilient return element configured to act on the dispensing head in order to close the stopper.

11 Claims, 5 Drawing Sheets

(56) References Cited

U.S. PATENT DOCUMENTS

| | | | | | |
|---|---|---|---|---|---|
| 4,067,499 | A * | 1/1978 | Cohen | A61F 9/0008 | 222/105 |
| 4,160,513 | A * | 7/1979 | Cockerham | A47K 5/1211 | 222/181.2 |
| 4,886,189 | A * | 12/1989 | Vanderjagt | B67D 7/0255 | 222/49 |
| 5,238,150 | A * | 8/1993 | Williams | B05B 9/0838 | 222/105 |
| 7,337,922 | B2 * | 3/2008 | Rake | A61M 5/148 | 128/DIG. 12 |

* cited by examiner

COSMETIC POT COMPRISING A SYSTEM FOR PRESSURIZING A PRODUCT SUPPLY CONTAINER

The present application concerns the field of pots, and in particular cosmetic pots designed to deliver a cream.

Conventionally, a pot for a cosmetic product comprises a base, generally of glass or of plastic, that is to say a container surmounted by a neck of which the diameter size is in the vicinity of the cross-section dimensions of the base, to have a wide opening. The base is generally closed by a lid, often screwed onto the neck. Where appropriate the lid is furthermore generally equipped with a seal having the role of providing sealing for closing for good preservation of the product contained.

Usually, a user opens the lid, collects cream using her fingers then closes the lid. In these conditions, the cream is momentarily exposed to the air, and it is furthermore possible for the fingers, by their contact, to contaminate the cream which remains in the pot.

In order to better ensure the sealing of the pot, and better protect the cream, it may then be advantageous for the pot to be provided with a pump or other device enabling the cream to be delivered dose after dose with the supply of cream enclosed in a closed container.

Document WO 2014 208 945 is for example known which describes a pot for dispensing a paste-like product comprising a tub of which an upper surface is covered with a plate which is perforated to make product come out of the tub. Progressively as the tub empties, the plate sinks into the tub. The cream is collected from the plate and only a small amount of cream is exposed to the air, the cream which is in the pot being at all times protected from the air by the pot wall and the plate.

However, a drawback lies in the fact that the pot must have a relatively large diameter in order for a user to be able to press on the plate regardless of how far it has sunk inside the tub.

The present application is directed to providing an improved pot base, which preserves the product as well as possible and which dispenses a dose of product with a movement by a user which is easy and natural.

To that end, according to a first aspect, there is provided a cosmetic pot having a base comprising:

- A body, formed by a bottom and by a lateral wall extending from the bottom,
- A reference wall, referred to as a press bottom, fastened to the body parallel to the bottom, and comprising an opening for product to pass,
- A container of variable volume, attached to the press bottom and positioned on one side of the press bottom, between the bottom of the body and the press bottom, the container having a volume that is variable depending on an amount of product it contains and comprising an outlet opening for product communicating with the opening of the press bottom,
- A pressurizing system of the container configured for compressing the container against the press bottom, and
- A product dispenser, disposed on an opposite side of the press bottom to the side where at the container is disposed and communicating with the opening of the press bottom, the product dispenser comprising a stopper, a dispensing head configured to dispense product to a user and open or close the stopper, and an elastic return member configured to act on the dispensing head to close the stopper, the product dispenser being configured to take an open configuration, in which the stopper is open and product is dispensed, and a closed configuration in which the stopper is closed; the product dispenser passing from the closed configuration to the open configuration by a movement of the dispensing head from a stable position to an unstable position inducing opening of the stopper, and the return member being configured to bring back the dispensing head from the unstable position to the stable position.

Such a base makes it possible to preserve the product while avoiding it coming into contact with air on each occasion of use. Furthermore, cooperation between the pressurizing system of the container and the product dispenser enables a desired dose of product to be dispensed with each movement of the dispensing head. The user controls the dispensing of the product, simply by pressing on the dispensing head, and thus by a natural manipulation by which the moreover collects a dose of product at the surface of the dispensing head using her fingers or according to requirement using an application accessory such as a sponge or a puff.

Furthermore, such a base can thus have different types of dimension, for example be tail and narrow.

Furthermore, such a base makes it possible to avoid having a pump.

According to a preferred embodiment, the container is a deformable flexible envelope.

According to another example embodiment, the container is possibly of the type described in document FR 2 869 771, i.e. a container formed from rigid parts some of which are movable relative to others. This container then comprises a cylindrical tub and a movable plate which moves in the tub progressively as the product is dispensed, in this case, the pressurizing system acts on the movable plate.

Optionally, in this case, the press bottom and/or at least part of the base could be formed as a one-piece member.

According to an example embodiment, the dispensing head comprises at least one dispensing channel to deliver product to the user.

The pressurizing system of the container, the viscosity of the product and the dimension of the channel or channels of the dispensing head cooperate so as to regulate the rate of flow of dispensing the product, that is to say its outlet speed, progressively as the container empties.

Such a dispensing channel is formed in the dispensing head. An intersection between the dispensing channel and an upper surface of the dispensing head defines a cross-section of the dispensing channel. In an advantageous embodiment, the cross-section of the dispensing channel represents a figure, an initialism or a logo for example.

According to an example embodiment, the dispensing head successively comprises an upper surface, a dispensing plate, configured to dispense product, and a distributing plate, configured to distribute product under the dispensing plate.

In general terms, a dispensing head comprising a distributing plate and a dispensing plate which are distinct from each other, that is to say in two parts, enables better distribution and dispensing of the product to a user.

In this case, the upper surface of the dispensing head is an upper surface of the dispensing plate.

According to an example embodiment, the dispensing head comprises a perforated covering.

In this case, the upper surface of the dispensing head is an upper surface of the perforated covering.

For example, the perforated covering is a woven textile or a stitch-based fabric, which may be natural or synthetic.

For example, the perforated covering comprises perforations of characteristic size comprised between 80 μm and 500 μm, preferably between 100 μm and 300 μm. A characteristic dimension here designates a diameter or a side of a polygon according to the nature of the perforation considered.

According to an advantageous example embodiment, the stopper comprises at least:

a closure, fastened to the press bottom, and a bellows, comprising an upper neck fastened to the dispensing head, a lower neck fastened to the press bottom, and a body extending between the upper neck and the lower neck, at least part of the closure and the bellows defining between them a transit volume for the product between the container and the dispensing head.

According to an example embodiment, in closed configuration of the product dispenser, the upper neck of the bellows is in contact with part of the closure and, in open configuration of the product dispenser, the upper neck of the bellows and said part the closure define between them a space and product is dispensed; the product dispenser passing from the closed configuration to the open configuration by a movement of the dispensing head from the stable position to the unstable position inducing compression of the bellows.

According to an example embodiment, the stopper comprises a fixed part and a part that is movable relative to the fixed part; the fixed part comprising a closure and the movable part comprising a bellows, the return member and a head plate, the head plate being linked to the dispensing head and furthermore being linked to an upper neck of the bellows.

According to an example embodiment, the pressurizing system of the container is configured to apply to the container a constant force as emptying of the container progresses.

By constant it is meant here that the pressure applied to the container when this is empty is at least equal to 70%, or even 80%, or even 90%, or even 95%, or possibly even 98% of the pressure applied to the container when the latter is full.

A pressurizing system according to the invention in particular makes it possible to avoid having an air inlet in the bottom of the base.

According to an example embodiment, the pressurizing system comprises a block of foam, in particular a block which has viscoelastic properties.

The use of a block of foam enables dispensing of the product under a low pressure, and in the case of "shape memory" viscoelastic foam, that is to say foam which returns to its initial form, it is possible to dispense the product with a constant or practically constant flow rate over the entire life of the product.

According to a variant, the pressurizing system possibly comprises a spring or other elastic return device which acts alone or in combined action with the block of foam.

For example, the base comprises a ring, positioned inside the container and attached to the press bottom.

In an example embodiment, a wall of the container is pinched between the press bottom and the ring in order for the container to be fastened to the press bottom.

According to an example embodiment, the container comprises a refill port provided in a bottom of the container and the bottom of the body of the base.

A refill port makes it possible for example to perform initial filling of the container and/or to refill it with product after use by a user.

In an example embodiment not shown, the refill port and the press bottom have complementary shapes such that the container is completely crushed at the end of life of the product.

BRIEF DESCRIPTION OF THE DRAWINGS

The invention, according to an example embodiment, will be well understood and its advantages will be clearer on reading the following detailed description, given by way of illustrative example that is in no way limiting, with reference to the accompanying drawings in which.

DETAILED DESCRIPTION OF THE INVENTION

Figure 1:
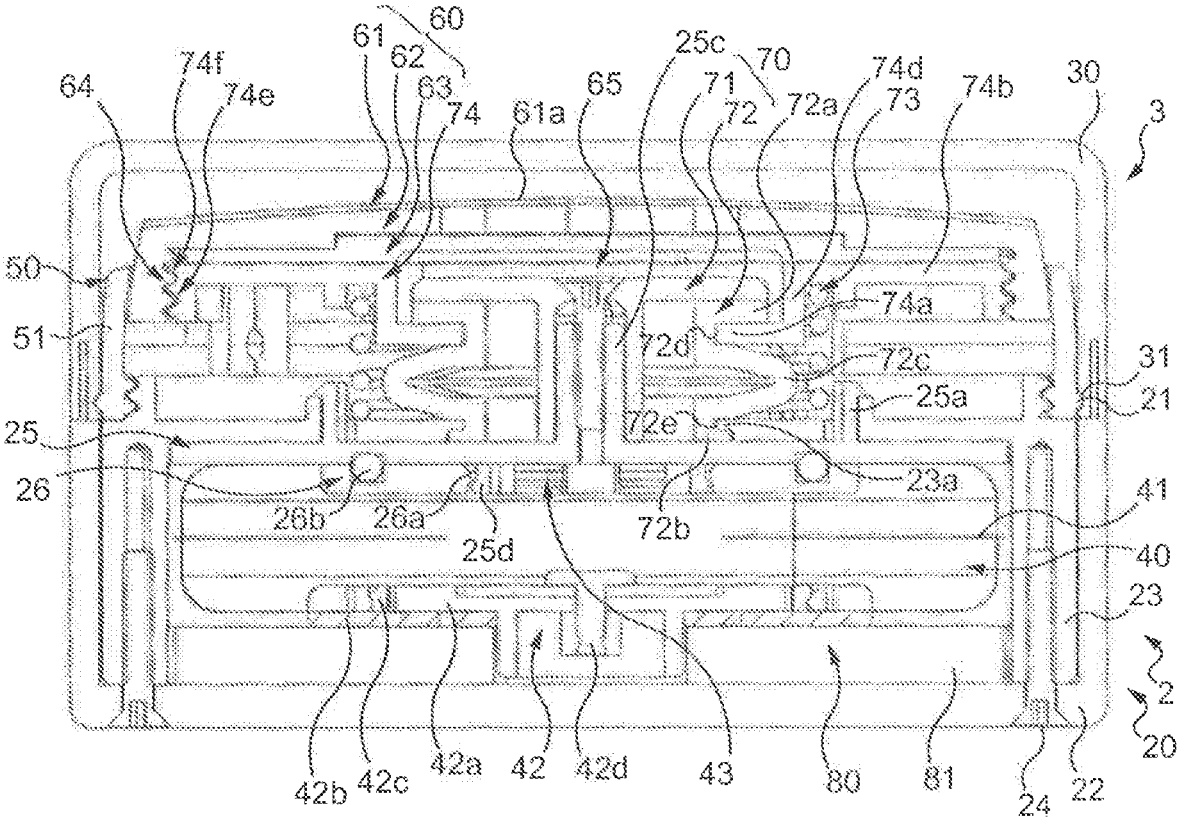
FIG. 1 presents a cross-section of a cosmetic pot according to an example embodiment of the present invention in closed configuration.

Identical parts represented in the aforementioned figures are identified by identical numerical references.

The present description is mainly given with reference to a pot of round contour but it would of course be valid for a pot of square or arbitrary contour.

As a matter of fact, traditionally, a cosmetic pot 1 has a contour which is round like that represented here in the drawings, or often substantially square.

The pot 1 comprises a base 2 and a lid 3 enabling the pot 1 to be opened or closed.

The lid 3 is formed here by a cap 30.

The cap covers the product dispenser when the pot is not used.

The cap 30 for example has a contour of the same shape as the base 2.

The closing of the cap is advantageously made in fluid-tight manner, for example by friction, for example by means of a peripheral bead which enters a groove for example.

Here, to close the pot in cooperation with the base, the cap 30 comprises a groove 31 configured to clip onto a bead 21 of the base 2.

In general, the lid 3 may be attached to the base 2 by any means to close the pot 1, for example be clipped or screwed onto the base 2 or instead, the lid and the base may be provided with a hinge in one place and with a button in another place.

The base 2 comprises a body 20. The body 20 is formed by a bottom and by a lateral wall extending from the bottom, which defines an interior of the body of the base.

The body 20 is for example of plastic or of metal.

The body 20 is formed here from an outside casing 22 and an inside casing 23. The outside casing 22 and the inside casing 23 are assembled to each other here with screws 24.

However, the body 20 could be formed just by a single member, for example the two casings forming one member, or by several members assembled by screws, adhesive or any assembly mechanism for example.

The base 2 here comprises a wall, referred to as reference wall, here designated "press bottom 25".

The press bottom 25 here covers an envelope 40 of product supply and a pressurizing system 80 of the envelope 40 which will be described later. For this, the press bottom 25 here takes the form of a plate of which the outside contour follows the periphery of an inside cross-section of the body 20, and more particularly here, of an inside cross-section of the inside casing 23.

The press bottom 25 is fastened to the body 20, and more particularly here to the inside casing 23. It is positioned parallel to the bottom of the body.

In the present example embodiment, the press bottom 25 comprises lugs 25*a* configured to hook onto a rim of the body 20, and in particular here, of the inside casing 23.

More specifically here, the inside casing 23 comprises a part which extends above the press bottom 25 and which comprises windows in which engage the lugs 25*a* in order for the press bottom 25 to be hooked onto the inside casing 23.

The press bottom 25 here comprises a pin 25*c* on which comes to be positioned a closure 71 described later. In particular, the pin 25*c* is inserted here into a foot 71*b* of the closure. Furthermore, the pin 25*c* here comprises an threaded bore in which a screw is inserted to fasten the closure 71 to the press bottom 25.

However, according to another example not shown, the bore is absent, and/or the closure 71 is attached to the press bottom 25 by another means, for example by bonding.

The press bottom 25 also comprises an opening 25*b* (visible in FIG. 2), here composed of several windows. The opening 25*b* is provided facing an outlet opening 43 for outletting product from the envelope 40. In particular here, the opening 25*b* is provided around the pin 25*c* and even around the foot 71*b* of closure 71 (described later) when the latter is in place on the press bottom 25. Thus, the product coming from the envelope 40 can flow around the foot 71*b* of the closure 71.

The base 2 also comprises the envelope 40 of product supply.

The envelope 40 is positioned here within the body 20 of the base 2. More particularly, between the bottom of the body and the press bottom 25.

The envelope 40 advantageously here has a variable volume according to the amount of product it contains, and is subjected to the action of a pressurizing system 80 which is described later.

The envelope is for example here a deformable envelope formed with a heat-welded complex. In the drawings, the envelope 40 is in two halves which are assembled together along a weld line 41.

The envelope 40 comprises an outlet opening 43 for product (visible in FIG. 2) through which the product it contains is conveyed to exit from the base.

The opening 43 is positioned here in the upper part of the envelope 40.

To attach the envelope to the press bottom 25, the base comprises a ring 26. It is formed here by a flat annulus. It comprises in particular an inside rim 26*a*, here of circular shape, which delimits the opening 43 of the envelope 40.

The ring 26 is hooked under the press bottom 25, and places the inside of the envelope in fluid-tight communication with the opening 25*b*.

For this, the press bottom 25 here comprises lugs 25*d* which extend towards an interior of the envelope 40 and which grip the inside edge 26*a* of the ring.

Furthermore, the ring 26 comprises a channel in which is positioned a seal 26*b*, and advantageously the press bottom 25 also comprises a corresponding channel.

Thus, before performing the welding of the envelope 40, members for connecting the envelope 40 with the product dispenser 50, for example such as the ring 26, or even the seal 26*b* also, are inserted into the envelope 40.

A wall of the envelope 40 is thus pinched between the ring 26 and the press bottom 25.

Other modes of construction may also be suitable.

The base 2 is provided here with a product dispenser 50 formed as follows, disposed above the pressurizing system 80, the envelope 40 and the press bottom 25.

The product dispenser 50 comprises a stopper 70 and a dispensing head 60.

The stopper 70 here comprises a part that is fixed relative to the body 20 of the base 2 and a part which is movable relative to the fixed part.

Figure 2:
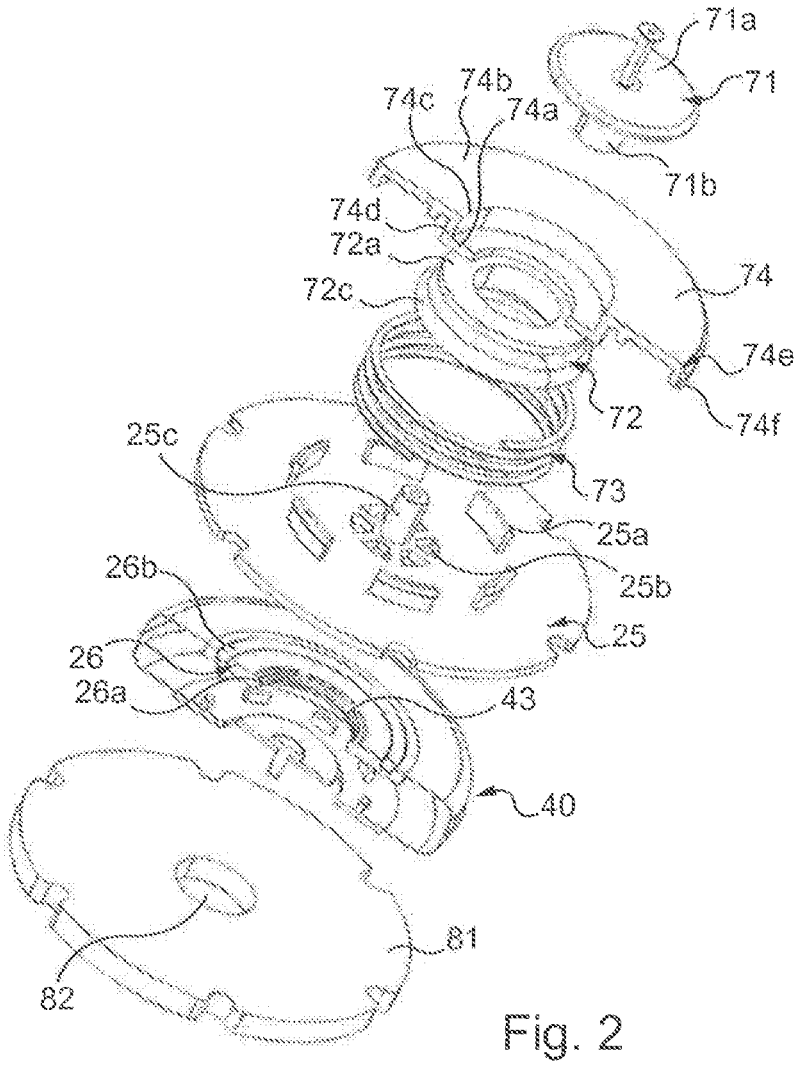
FIG. 2 shows an exploded view of a pressurizing system, of an envelope and part of a product dispenser of the pot of FIG. 1.

The fixed part comprises the closure 71 which in the drawings presents a plate 71*a* and a foot 71*b* (see for example FIG. 2).

The plate 71*a* and the foot 71*b* are formed here as a single piece here but they could be two distinct members assembled to each other.

Here, the plate 71*a* has a disk shape and the foot 71*b* has a cylindrical shape of circular cross-section. The foot is furthermore positioned substantially in the center of the disk here.

Furthermore, in the present example embodiment, the closure 71 comprises a bore which passes through both the plate 71*a* and the foot 71*b* in order for a screw to fasten the closure 71 to the press bottom 25.

In particular here, the screw is inserted into the threaded bore formed in the pin 25*c* of the press bottom 25.

The movable part here comprises a bellows 72 (of which one foot is however fixed), a return member 73 and a head plate 74.

The bellows 72 here comprises an upper neck 72*a*, a lower neck 72*b* and a body 72*c* which extends between the upper neck 72*a* and the lower neck 72*b*.

Here, the bellows 72 has rotational symmetry.

The bellows 72 is positioned here between the press bottom 25 and the head plate 74.

Furthermore, the bellows 72 at least partly surrounds the closure 71. More specifically here, the bellows 72 surrounds the foot 71*b* of the closure 71.

Thus, the bellows 72 and the closure 71 define between them a transit volume for the product between the envelope 40 and the dispensing head 60.

The upper neck 72*a* is fastened to the head plate 74. For this, in the present example embodiment, the bellows 72 comprises a groove, referred to as upper groove 72*d* and the head plate 74 comprises a rib 74*a* located at the bottom of a housing 74*d*; the rib 74*a* is inserted into the upper groove 72*d*, such that a movement of the head plate 74 here drives compression of the bellows 72.

Furthermore, the groove 72*d* here is continuous and is formed ail around the bellows 72 and the rib 74*a* is continuous and also surrounds the bellows 72. However, the rib and/or the rib could be discontinuous.

The lower neck 72*b* is fastened to the press bottom 25. More specifically here, the lower neck 72*b* merely bears against the press bottom 25. Furthermore, in the interest of security with regard to fluid-tightness and positioning of the various members present, the bellows comprises a groove, referred to as lower groove 72*e*, and the body 20 comprises a rib 23*a*, and the rib 23*a* of the casing 20 is inserted into the lower groove 72*e*, such that the lower neck 72*b* is held in position relative to the casing 20.

More particularly in the present example embodiment, the part of the inside casing 23 that extends above the press bottom 25 comprises the rib 23*a*.

In this way, part of the lower neck 72*b* is included between the rib 23*a* and the press bottom 25.

Furthermore, the lower groove 72*e* here is continuous and is formed all around the bellows 72 and the rib 23*a* of the casing is continuous and also surrounds the bellows 72. However, the rib and/or the rib could be discontinuous.

Figure 5:
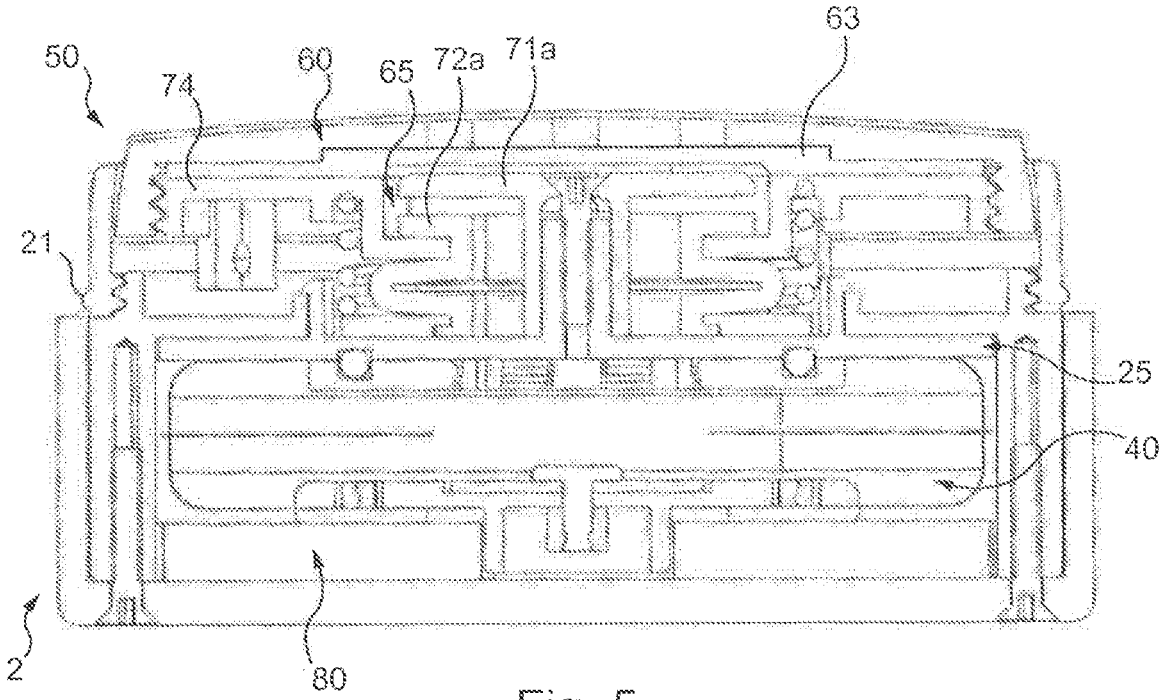
FIG. 5 shows the pot of FIG. 1 in open configuration.

Thus, as illustrate FIGS. 1 and 8, the upper neck 72*a* of the bellows 72 and the closure 71, and even here the plate 71*a*, are in contact when the stopper 70 is closed and, as shows FIG. 5, define between them a space when the stopper 70 is open.

The return member 73 is held between the head plate 74 and the press bottom 25. The return member 73 is configured to bring the head plate 74 from an unstable position to a stable position in which the rib 74*a* and the upper neck 72*a* of the bellows have come to bear against the closure 71, thereby obturating a passage between the upper neck of the bellows and the closure. Starting from the stable position, the head plate may be lowered parallel to itself, or askew, thereby opening the passage between the upper neck 72*a* and the closure 71.

The return member 73 is for example a spring 73, and in this case a helical spring.

The return member 73 is held in bearing relationship, under the head plate 74 and also over the press bottom 25, and in particular here over the part of the inside casing 23 that extends above the press bottom 25.

Furthermore, in the present example embodiment, the return member 73 surrounds the rib 74*a* of the head plate 74 and is surrounded by the lugs 25*a* of the press bottom 25 which project across the part of the inside casing 23 that extends above the press bottom 25.

When the upper neck 72*a* of the bellows 72 is contact with the closure 71, that is to say when the stopper is closed, the return member 73 is in neutral position or in compression so as to push away the head plate 74 relative to the press bottom 25. When the stopper is open, the return member 73 is in compression relative to its position when the stopper is closed.

Lastly, the head plate 74 mainly comprises a disk 74*b* comprising a central opening 74*c* here of circular shape.

The head plate 74 further comprises a housing 74*d* which extends from the central opening 74*c*, here substantially orthogonally to the disk. The housing 74*d* is thus linked here to the disk 74*b* and is furthermore linked to the rib 74*a* which here delimits a mouth of the opening, a cross-section of the mouth being less than a cross-section of the housing. The housing 74*d* is provided to receive the plate 71*a* of the closure 71. To that end it has a diameter greater than the diameter of the plate 71, while the diameter of the opening defined by the rim 74*a* is less than the diameter of the plate. The inside diameter of the lower and upper necks 72*a* and 72*d* of the bellows is substantially greater than the diameter of the foot 71*b* of the closure 71 to enable product to pass from the opening 25*b* of the press bottom 25 to the central opening 74*c* of the head plate 74.

Lastly, the head plate 74 comprises a peripheral outside wall 74*e* here provided with a screw thread 74*f*.

The dispensing head 60 principally takes the form of a plate.

Furthermore, it is perforated such that product is able to pass through the dispensing head to be dispensed to a user, in other words, the dispensing head 60 comprises at least one channel to dispense product to a user.

The dispensing head 60 comprises an upper surface 61*a* configured for a user to press on with her fingers or an accessory such as a sponge or a puff to induce a local pressure and collect a dose of product which is dispensed to the surface of the dispensing head.

In the present example embodiment, the dispensing head has a disk shape and the upper surface 61*a* is domed.

The dispensing head 60 also comprises, on its lower part, a peripheral screw thread 64 provided to cooperate with the screw thread 74*f* of the head plate 74 in order to couple together these two members. Those coupling means may also be suitable.

In the illustrated example embodiment, the dispensing head 60 is thus fastened to the head plate 74 and is surrounded by a peripheral ring 51.

The peripheral ring 51 comprises an inside surface having a shape curved towards the inside or which is for example conical.

The peripheral ring 51 thus potentially serves as a guide for the dispensing head 60 when the latter is moved.

The peripheral ring 51 is fastened to the body 20, and in this case to the inside casing 23. In the present example embodiment, the peripheral ring is screwed thereto.

Furthermore, in this example, the bead 21 of the base 2 is formed over an outside surface of the peripheral ring 51. Other modes of construction may also be suitable.

In the example embodiment presented here, the dispensing head 60 comprises several members assembled together.

The dispensing head 60 in this case comprises, starting from the upper surface 61*a*: a covering 61, a dispensing plate 62 and a distributing plate 63.

The covering 61 here comprises the upper surface 61*a*.

The covering 61 is for example bonded to the dispensing plate 62.

The covering 61 is advantageously a perforated covering.

If for example covers a woven textile or a natural or synthetic stitch-based fabric. The stitches for example have an opening which depends on the viscosity of the product. It is for example of the order of 80 to 500 micrometers, preferably 100 to 300 micrometers (indicative values). The size of the perforations means that the product passes through the perforations preferably only when passage of the fingers induces a local pressure on the upper surface of the covering.

The covering is potentially made from a material chosen for its softness of contact with the fingers, for example a velvet.

The covering is for example bonded, or welded or assembled mechanically to the dispensing plate or to its neighboring plate if the dispensing head comprises fewer plates than in the present example embodiment, it may also be integral with the dispensing plate, that is to say it could form a single part with it. In this case, the covering is of the same material as the dispensing plate.

The dispensing plate 62 mainly comprises a disk with an upper surface which bears the covering 61, and a lower surface which is an opposite surface to the upper surface.

The disk may have a uniform thickness but in this case it is of variable thickness. Furthermore, the upper surface is domed.

Moreover, the lower surface comprises a debossed formation.

The dispensing plate here furthermore comprises a peripheral wall which extends in relief from the lower surface and which here comprises the screw thread 64 formed on an inside face of the peripheral wall.

The dispensing plate is thus screwed to the head plate 74, thus holding the distributing plate 63 in a sandwich.

The distributing plate 63 also mainly comprises a disk with an upper surface and a lower surface which is an opposite surface to the upper surface. The disk of the distributing plate may also have a uniform or variable thickness. Here, its upper surface further comprises a formation in relief of complementary shape to the debossed formation of the dispensing plate such that the distributing plate 83 is accurately in register with the dispensing plate 62.

Figure 3:
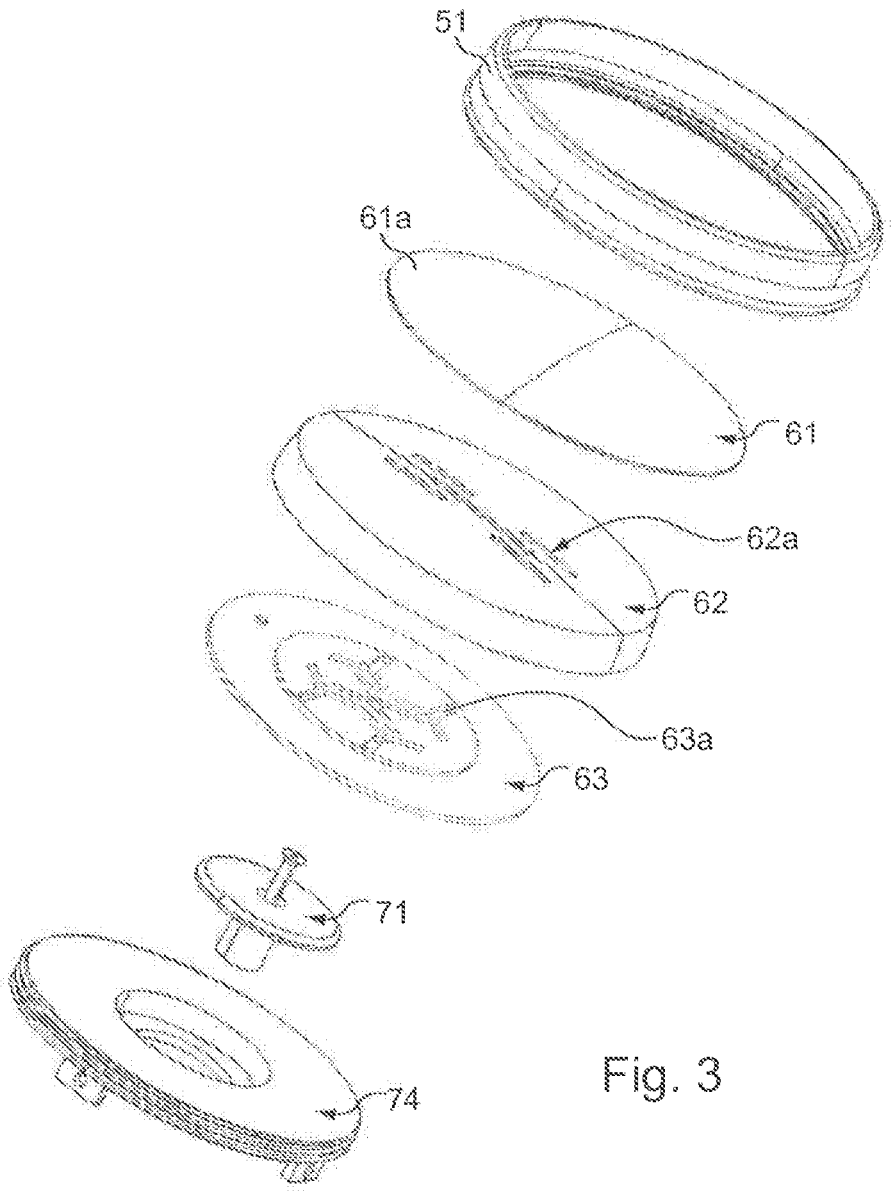
FIG. 3 shows an exploded view of another part of the product dispenser of the pot of FIG. 1 according to an example embodiment, FIG. 4 details an embodiment of a dispensing plate and of a distributing plate of a dispensing head.
Figure 4:
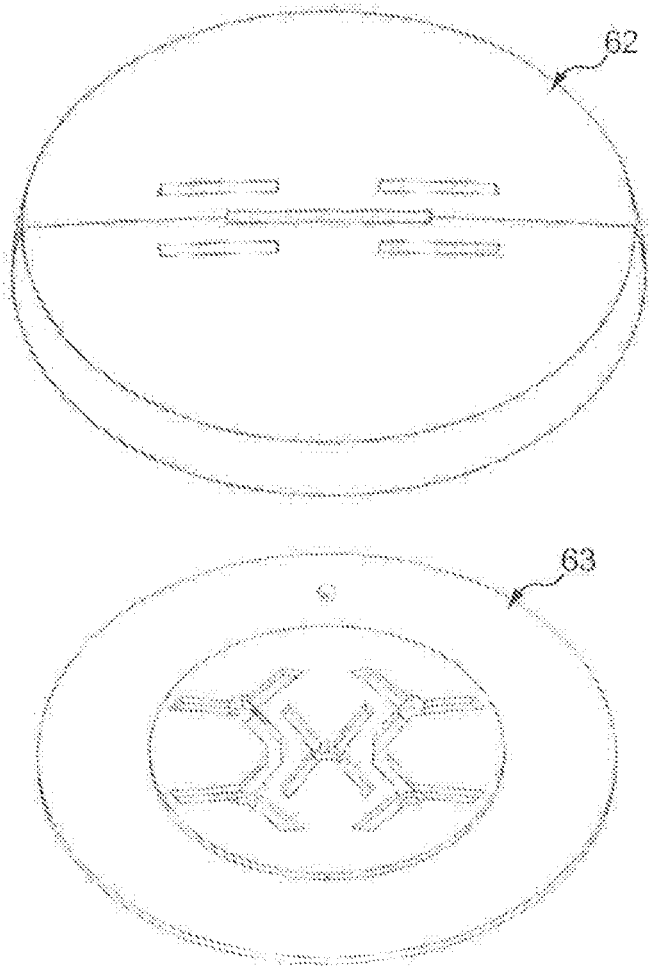

As illustrated by FIGS. 3 and 4, the dispensing plate 62 and the distributing plate 63 comprises through-channels, respectively 62*a* and 63*a*, which are configured to convey the product from the envelope 40 to the upper surface of the dispensing head 60.

In particular, in this embodiment, the channels 62*a* of the dispensing plate are configured to dispense product and the channels 63*a* of the distributing plate are configured to distribute product towards the dispensing channels of the dispensing plate.

To that end, the distributing channels are potentially wider than the dispensing channels.

FIG. 3 shows linear and parallel channels concentrated towards the center of the plate. This is not limiting and any other disposition of the perforations may be suitable. For example, the channels could have the form of a circle arc and be disposed towards the periphery of the plate, or instead be individual perforations locally concentrated or instead be spread over the whole surface of the plate. Another possibility is that the perforations are disposed to represent a shape, a figure or a logo of the brand for example.

At the location of the covering, a distinctive sign may be provided, for example a change in appearance or a colored mark, which indicates to the consumer the places where the product will be dispensed and which incites pressing of those locations in order for the dispensing head 60 to lower, thereby opening the passage between the stopper 71 and the upper neck 72*a* of the bellows.

According to another example embodiment not shown, the dispensing head only comprises a single plate in which the channels are formed at the time of its manufacture; in this case the covering is for example an upper surface layer of the dispensing head.

Or for example, the dispensing plate and the distributing plate are formed as one piece, for example by double injection molding.

Another possibility is that the distributing plate 63 has a network of channels which are open only towards the dispensing plate 62 and a lower central orifice by which the product is dispensed into the network of channels. In other words, the channels would only be hollowed out within part of the thickness of the distributing plate and would all be supplied by a well, the orifice, which would pass through the rest of the thickness of the distributing plate.

In the present example embodiment, the housing 74*d*, the rib 74*a* and the distributing plate 63 define between them a volume 65 in which can flow the product coming from the envelope before infiltrating into the channels of the distributing plates 63 then into the channels of the dispensing plate 62.

Furthermore, there are positioned in this volume 65 the upper neck 72*a* of the bellows 72 and at least part of the closure 71, in particular at least the plate 71*a*.

At rest, that is to say in stable position on the dispensing head, there is a space between the distributing plate 63 and the plate 71*a* at least equal to a distance travelled by the dispensing head when it is moved in order for product to be dispensed.

Lastly, the base 2 comprises a pressurizing system 80 of the envelope 40, configured to pressurize the envelope 40. It is positioned here under the envelope 40.

In other words, the envelope 40 is positioned here between the product dispenser 50 and the pressurizing system 80.

The envelope is thus pressurized by the pressurizing system 80, which produces a substantially constant force as emptying of the envelope progresses and thus as the pressurizing system expands. It will thus press the envelope against the wall forming the press bottom 25.

Advantageously, the pressurizing system 80 comprises a block of foam 81. The block is compressed when the envelope 40 is full of product, and expands progressively as the envelope empties.

The foam is of any appropriate nature, for example it is a polyether foam of which the density is comprised between 17 and 25 kg/m$^3$, or else a polyurethane foam of a density comprised between 35 and 55 kg/m$^3$.

A foam having viscoelastic properties may also be suitable, for example a viscoelastic foam of density comprised between 55 and 90 kg/m$^3$.

The particularity of such a foam is to apply a low pressure on the envelope, which pressure is substantially constant whatever the degree of compression of the block, thus whatever the degree of emptying of the envelope, and to have shape memory, that is to say a capacity to recover its initial shape.

Lastly, the envelope 40 here has a refill port 42 provided with a valve, referred to as refill valve, for if to be filled and where required to be refilled with product.

If a refill port 42 is present, the pressurizing system 80 advantageously comprises a passage enabling access thereto. In this case, the block of foam 81 comprises a hole 82 for example.

The refill port here comprises an inside member 42*a* positioned in the envelope 40 and an outside member 42*b* positioned outside the envelope 40.

The inside member 42*a* and the outside member 42*b* are hooked to each other by pinching a wall of the envelope 40 between them. For this, the envelope comprises for example an opening, distinct from the opening 43 already described, advantageously positioned in a bottom of the envelope. For example, the outside member 42*b* comprises lugs 42*c* which extend into the envelope and grip within openings of the inside member 42*a* provided for that purpose.

The refill port 42 comprises a movable closure 42*d*, with a plate and a foot, the plate being positioned in the envelope and the foot extending out of the envelope.

Furthermore, here, the inside member 42*a* comprises an extension, here tubular, which extends out of the envelope and passes through the outside member 42*b*. This extension in particular serves to define an access to the movable closure 42*d* of which the movement enables the envelope 40 to be filled or refilled.

In an example embodiment not shown, the refill port 42 and the press bottom 25 have complementary shapes such that the envelope is not completely crushed at the end of life of the product.

According to still another example embodiment not shown, instead of providing a refill by injection of product into the envelope via the refill port, the envelope is replaced by another envelope.

In this case the refill port would only serve for the initial filling of the envelope in the factory for example or it is possible for the envelope not have one.

The dispensing head 60 is thus configured to open or close the stopper 70.

Figure 6:
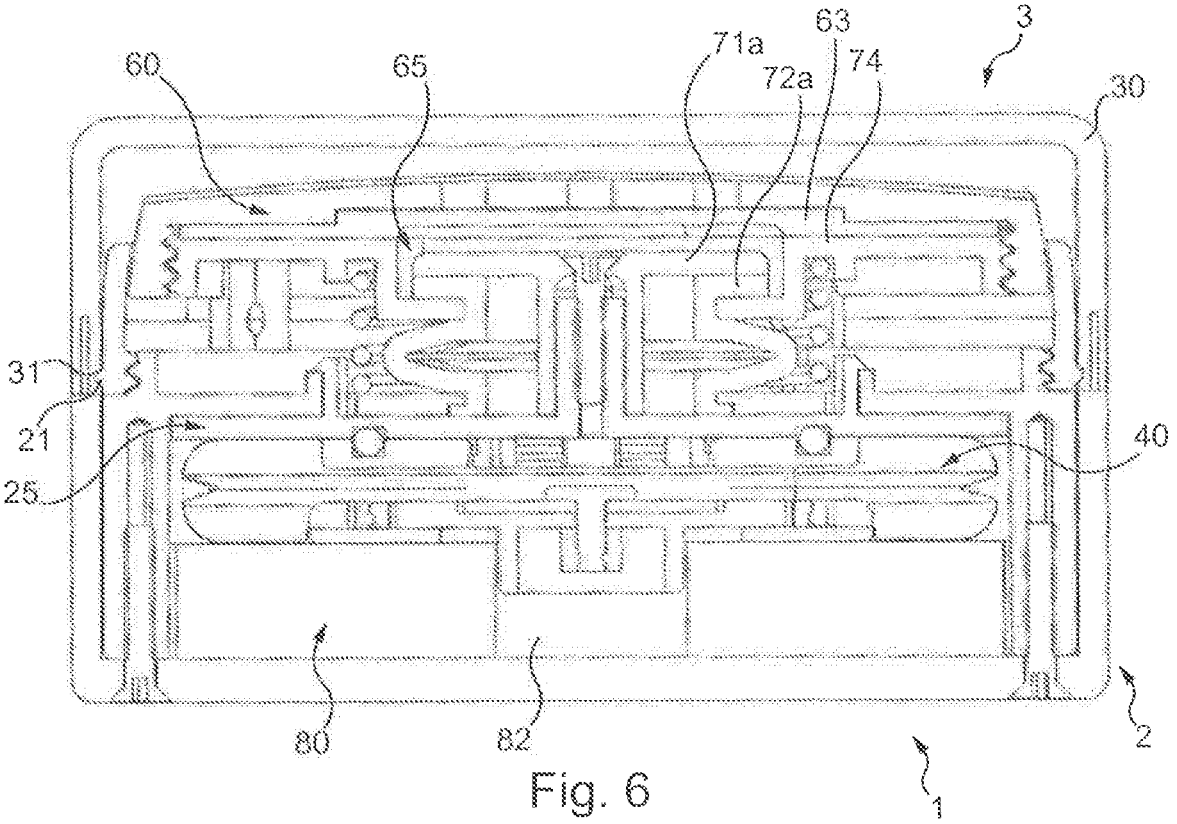
FIG. 6 shows the pot of FIG. 1 in closed configuration when the envelope is emptied by approximately half.

The product dispenser 50 is thus configured to have an open configuration, in which the stopper is open (as illustrated for example in FIG. 5) and product is dispensed, and a closed configuration (as illustrated by FIGS. 1 and 6), in which the stopper is closed.

The product dispenser 50 passes from the closed configuration to the open configuration by a movement of the dispensing head 60 from a stable position to an unstable position which drives the head plate 74, the dispensing head 60 passing from the unstable position to the stable position, in particular by virtue of a return member 73.

Here, the stable position corresponds to what is referred to as a high position, and the unstable position corresponds to what is referred to as a low position.

In other words, in the embodiment represented in the drawings, the dispensing head 60 passes from the stable position to the unstable position if a user presses thereon.

This leads to the opening of the stopper 70 being obtained by a press which pushes in the dispensing head, vertically or slantingly.

More specifically, the movement of the dispensing head 60 leads, via the head plate 74, to crushing of the bellows 72 which opens a passage between the upper neck 72*a* of the bellows 72 and the closure 71, in particular the plate 71*a*, as illustrated by FIG. 5. And when the dispensing head 60 is released, the return member 73, pushes back the head plate 74 which drives the dispensing head 80, giving rise to expansion of the bellows 72 and the upper neck 72*a* of the bellows returns into contact with the closure 71, and in particular with the plate 71*a*.

Thus, on opening the stopper, the envelope delivers product towards the dispensing head under the effect of the pressure to which the envelope is subjected.

As a variant of the construction which has been described, the container with a variable volume constituted by the flexible envelope described above could include, instead of the flexible envelope, a device such as that described for example in patent application FR 2 869 771, i.e. a container formed from rigid parts of which some are movable relative to others. This container then comprises a cylindrical tub with a downwardly oriented opening, and a movable plate which moves in the tub progressively as the product is dispensed. In this case, the pressurizing system 80 of the present application would act on the movable plate. Also, in this case, the tub, the press bottom and/or the inside casing could form a single one-piece member.

All the features presented in the context of the present description in relation with the flexible envelope can thus be extrapolated to a deformable container.

According to another variant, the pressurizing system 80 of the present application comprises a spring or other elastic return device which acts alone or in combined action with the block of foam.

The invention claimed is:

1. A cosmetic pot having a base comprising:

a body formed by a bottom and by a lateral wall extending from the bottom;

a reference wall, referred to as a press bottom, fastened to the body parallel to the bottom, and comprising an opening for product to pass;

a container of variable volume, the container being attached to the press bottom and positioned on one side of the press bottom, between the bottom of the body and the press bottom, the container having a volume that is variable depending on an amount of product the container contains and comprising an outlet opening for product communicating with the opening of the press bottom;

a pressurizing system of the container configured for compressing the container against the press bottom; and a product dispenser, disposed on an opposite side of the press bottom to the one side where the container is disposed and communicating with the opening of the press bottom, the product dispenser comprising a stopper, a dispensing head configured to dispense the product to a user and open or close the stopper, and an elastic return member configured to act on the dispensing head to close the stopper;

the product dispenser being configured to take an open configuration, in which the stopper is open and the product is dispensed through an upper surface of the dispensing head, and a closed configuration in which the stopper is closed;

the product dispenser passing from the closed configuration to the open configuration by a movement of the dispensing head from a stable position to an unstable position, by pressing on the upper surface of the dispensing head, inducing opening of the stopper; and the return member being configured to return the dispensing head from the unstable position to the stable position.

2. A cosmetic pot according to claim 1, wherein:

the container with a variable volume is a deformable envelope.

3. A cosmetic pot according to claim 1, wherein:

the dispensing head comprises at least one dispensing channel to deliver the product to the user.

4. A cosmetic pot according to claim 1, wherein:

the dispensing head comprises a perforated covering.

5. A cosmetic pot according to claim 1, wherein:

the dispensing head successively comprises an upper surface, a dispensing plate, configured to dispense product, and a distributing plate, configured to distribute the product under the dispensing plate.

6. A cosmetic pot according to claim 1, wherein:

the stopper comprises at least:

a closure, fastened to the press bottom, and a bellows, comprising an upper neck linked to the dispensing head, a lower neck fastened to the press bottom, and a body extending between the upper neck and the lower neck;

between at least part of the closure and the bellows a transit volume for the product is defined between the container and the dispensing head.

7. A cosmetic pot according to claim 6, wherein:

in the closed configuration of the product dispenser, the upper neck of the bellows is in contact with part of the closure;

in the open configuration of the product dispenser, between the upper neck of the bellows and said part the closure a space is defined and the product is dispensed; and the product dispenser passes from the closed configuration to the open configuration by a movement of the dispensing head from the stable position to the unstable position, inducing compression of the bellows.

8. A cosmetic pot according to claim 1, wherein:

the stopper comprises a fixed part and a movable part, the movable part being movable in relation to the fixed part;

the fixed part comprises a closure and the movable part comprises a bellows, the return member and a head plate; and the head plate is linked to the dispensing head and is furthermore linked to an upper neck of the bellows.

9. A cosmetic pot according to claim 1, wherein:

the pressurizing system of the container is configured to apply to the container a constant force as emptying of the container progresses.

10. A cosmetic pot according to claim 1, wherein:

the pressurizing system comprises a block of viscoelastic foam.

11. A cosmetic pot according to claim 1, wherein:

the container comprises a refill port provided in a bottom of the container and the bottom of the body of the base.

* * * * *